US011561000B1

(12) United States Patent
McKenna

(10) Patent No.: US 11,561,000 B1
(45) Date of Patent: Jan. 24, 2023

(54) LAMP ASSEMBLY

(71) Applicant: Steelcase Inc., Grand Rapids, MI (US)

(72) Inventor: Mark McKenna, East Grand Rapids, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 17/377,019

(22) Filed: Jul. 15, 2021

(51) Int. Cl.

| | |
|---|---|
| ***F21V 21/06*** | (2006.01) |
| ***F21V 14/02*** | (2006.01) |
| ***F21V 21/30*** | (2006.01) |
| ***F21S 6/00*** | (2006.01) |
| ***F21V 33/00*** | (2006.01) |

(52) U.S. Cl.
CPC ..... *F21V 21/06* (2013.01); *F21V 14/02* (2013.01); *F21V 21/30* (2013.01); *F21S 6/002* (2013.01); *F21V 33/004* (2013.01)

(58) Field of Classification Search
CPC ..... F21S 6/002; F21S 6/003; F21V 21/06; F21V 21/30; F21V 21/26; F21V 21/116; F21V 33/004; F21V 14/02; F21V 14/025; F21V 9/40; A45D 42/10; A45D 33/32
See application file for complete search history.

(56) References Cited

U.S. PATENT DOCUMENTS 1,851,199 A * 3/1932 Mayer ..... F21V 21/06 248/302
1,912,902 A 6/1933 Kramer
2,466,722 A * 4/1949 May ..... F21V 21/26 248/278.1
D159,875 S 8/1950 Versen
D164,379 S 8/1951 Michie
D178,415 S 7/1956 Mugnai
D187,814 S 5/1960 Thurston
(Continued)

FOREIGN PATENT DOCUMENTS

EP 3316560 12/2020

OTHER PUBLICATIONS

"6.3-inch Portable Round Vanity Makeup Mirror & Phone Mount, USS Powered, LED Ring" (eBay) [online] <retrieved from URL: https://www.ebay.com/itm/333701833884?_ul=IL> Sep. 23, 2020 (Sep. 23, 2020), entire document.

*Primary Examiner* — Jong-Suk (James) Lee
*Assistant Examiner* — James M Endo
(74) *Attorney, Agent, or Firm* — Price Heneveld LLP

(57) ABSTRACT

A lamp assembly includes a base, a support arm coupled to the base, a housing coupled to the support arm, a mirror supported by the housing, a light arrangement supported in the housing, wherein the base, the support arm, and the housing are reconfigurable between a first configuration where the housing is located vertically above the base and a reflective surface of the mirror is parallel with a worksurface, a second configuration where the housing is located vertically above the base and the reflective surface is perpendicular to the worksurface, and a third configuration where the housing is located at least partially rearward of the base and the reflective surface is substantially perpendicular to the worksurface. The lamp assembly may further include a support member configured to cooperate with the base to support a personal communication device, and a rotatable portion of the housing which controls a light intensity.

28 Claims, 5 Drawing Sheets

(56) References Cited

U.S. PATENT DOCUMENTS 3,694,647 A * 9/1972 Chapman, Jr. ..... F21S 6/003 362/411
D286,818 S 11/1986 Engel
4,736,278 A 4/1988 Wolens
D296,480 S 6/1988 Engel
D309,833 S 8/1990 Wahl
D373,650 S 9/1996 John
5,586,820 A * 12/1996 Klink ..... F21S 6/003 362/419
6,019,484 A * 2/2000 Seyler ..... F21V 21/22 362/403
6,273,585 B1 * 8/2001 Wu ..... F21V 33/004 362/135
D500,156 S 12/2004 Kao
6,894,434 B1 * 5/2005 Kosoff ..... F21S 6/002 315/134
D506,018 S 6/2005 Campo
D547,555 S 7/2007 Lo et al.
D548,876 S 8/2007 Newhouse
D556,355 S 11/2007 Foster
D649,790 S 12/2011 Pitot
8,162,502 B1 * 4/2012 Zadro ..... F21V 33/004 362/427
9,347,660 B1 * 5/2016 Zadro ..... A45D 42/08
D768,077 S 10/2016 Wahl
D776,316 S 1/2017 Young
D776,336 S 1/2017 Ng et al.
D810,352 S 2/2018 Bibby
D825,822 S 8/2018 McKenna et al.
10,320,108 B2 6/2019 Hoshikawa
D854,227 S 7/2019 Yu
D871,648 S 12/2019 Tong
D879,481 S 3/2020 Yang
10,652,447 B1 * 5/2020 Pestl ..... A45D 42/10
D886,360 S 6/2020 Xu
D898,383 S 10/2020 Zhou
D899,491 S 10/2020 Zhuangxiaoyi
D899,669 S 10/2020 Yinquan
2004/0062048 A1 * 4/2004 Eusterbrock ..... F21V 23/04 362/411
2005/0146863 A1 * 7/2005 Mullani ..... G02B 27/281 362/140
2008/0291673 A1 * 11/2008 Chen ..... F21S 6/003 362/231
2010/0053942 A1 * 3/2010 Tarter ..... F21V 23/0414 362/182
2012/0162960 A1 * 6/2012 Lin ..... G02B 5/0242 362/19
2013/0201683 A1 * 8/2013 Kirchberger ..... F21V 21/30 362/249.02
2014/0362562 A1 * 12/2014 Fung ..... A45D 42/08 362/135
2017/0164719 A1 6/2017 Wheeler
2017/0307151 A1 * 10/2017 Deng ..... F21V 19/02
2017/0332460 A1 * 11/2017 Sato ..... F21V 14/02
2018/0191096 A1 * 7/2018 Hoshikawa ..... H01R 33/74
2018/0263362 A1 * 9/2018 Yang ..... F21V 33/004
2019/0003699 A1 * 1/2019 Mondora ..... A45D 42/10

* cited by examiner

LAMP ASSEMBLY

BACKGROUND OF THE INVENTION

These various embodiments as disclosed herein relate to a lamp assembly configurable between various modes of operation, including modes providing worksurface lighting and/or modes providing facial lighting and feedback to the user during videoconferencing.

SUMMARY OF THE INVENTION

A lamp assembly as disclosed herein may include a base configured to be supported on a worksurface, a support arm having a first end pivotably coupled to the base, and a second end, a housing pivotably coupled to the second end of the support arm, and a mirror supported by the housing and having a reflective surface facing in a first direction. The lamp assembly may further include a light arrangement supported in the housing and including a light element, the light arrangement configured to emit a light in the first direction, wherein the base, the support arm, and the housing are reconfigurable between a first configuration where the housing is located vertically above the base and the reflective surface is substantially parallel with the worksurface, a second configuration where the housing is located vertically above the base and the reflective surface is substantially perpendicular to the worksurface, and a third configuration where the housing is located at least partially rearward of the base and the reflective surface is substantially perpendicular to the worksurface.

The lamp assembly may further or alternatively include a base configured to be supported on a worksurface, a support arm having a first end operably coupled to the base, and a second end, a housing operably coupled to the second end of the support arm, and a lighting arrangement supported in the housing and including a lighting element configured to emit a light, wherein the lamp assembly is reconfigurable between a first configuration where the light is directed downwardly toward the worksurface, and a second configuration where the light is directed forwardly toward the face of the seated user. The lamp assembly may further include a support member coupled to and extending outwardly from the support arm, wherein the base and the support arm are configured to cooperate to support a personal communication device such that a camera of the personal communication device is directed toward the face of the seated user.

The lamp assembly may further or alternatively include a base configured to be supported on a worksurface, a support arm having a first end operably coupled to the base, and a second end, a housing assembly operably coupled to the second end of the support arm and having a central axis, the housing assembly including a hood and a graspable handle extending from the hood, and a light arrangement supported by the housing assembly and including a light element configured to emit a light, the hood operably coupled to the light element such that rotation of the hood about the central axis controls an intensity of the light.

These and other features, advantages, and objects of the present invention will be further understood and appreciated by those skilled in the art by reference to the following specification, claims, and appended drawings.

BRIEF DESCRIPTION OF THE DRAWINGS

FIG. 4;

DETAILED DESCRIPTION

Figure 1:
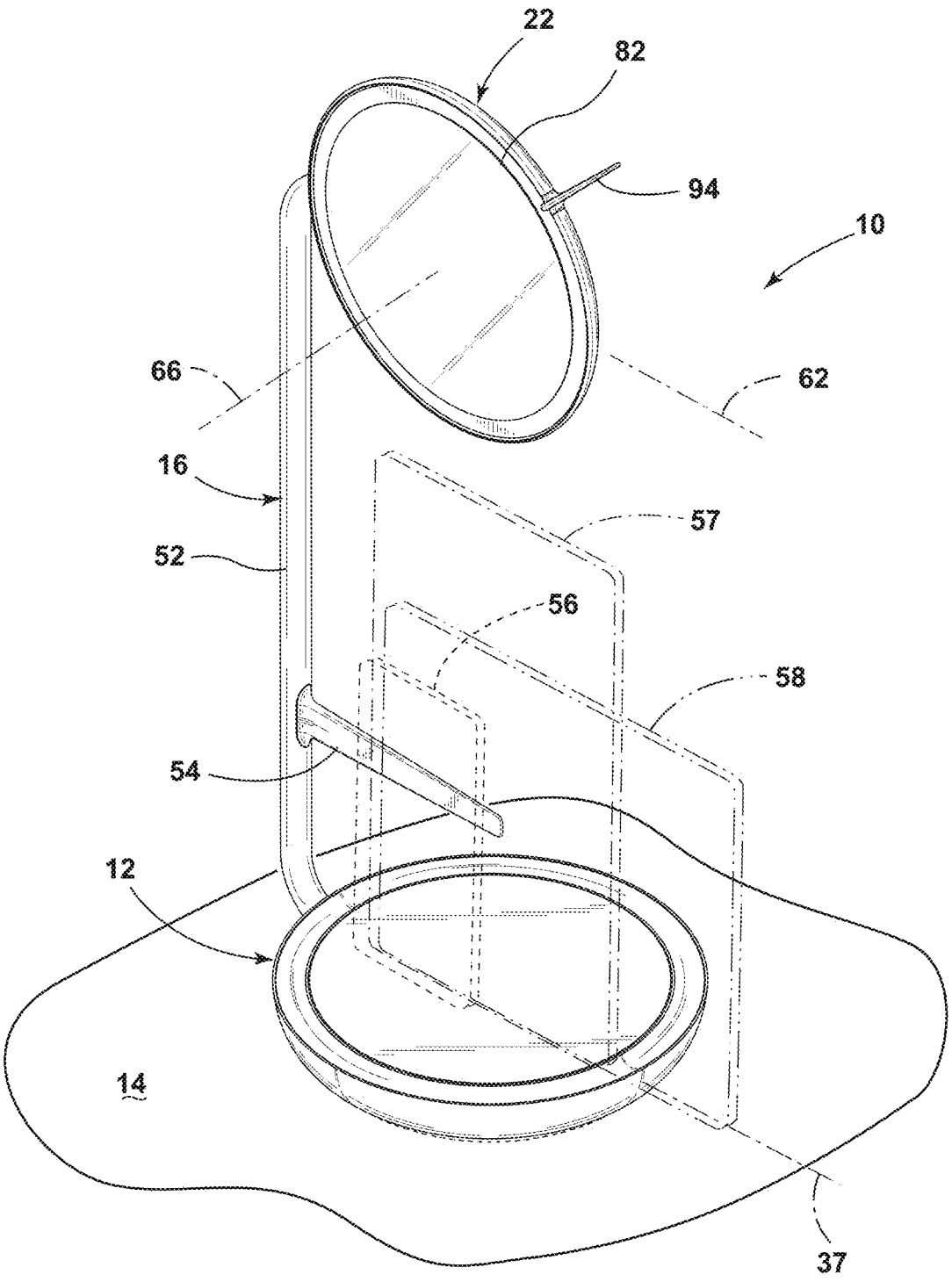
FIG. 1 is a front perspective view of a lamp assembly.
Figure 2:
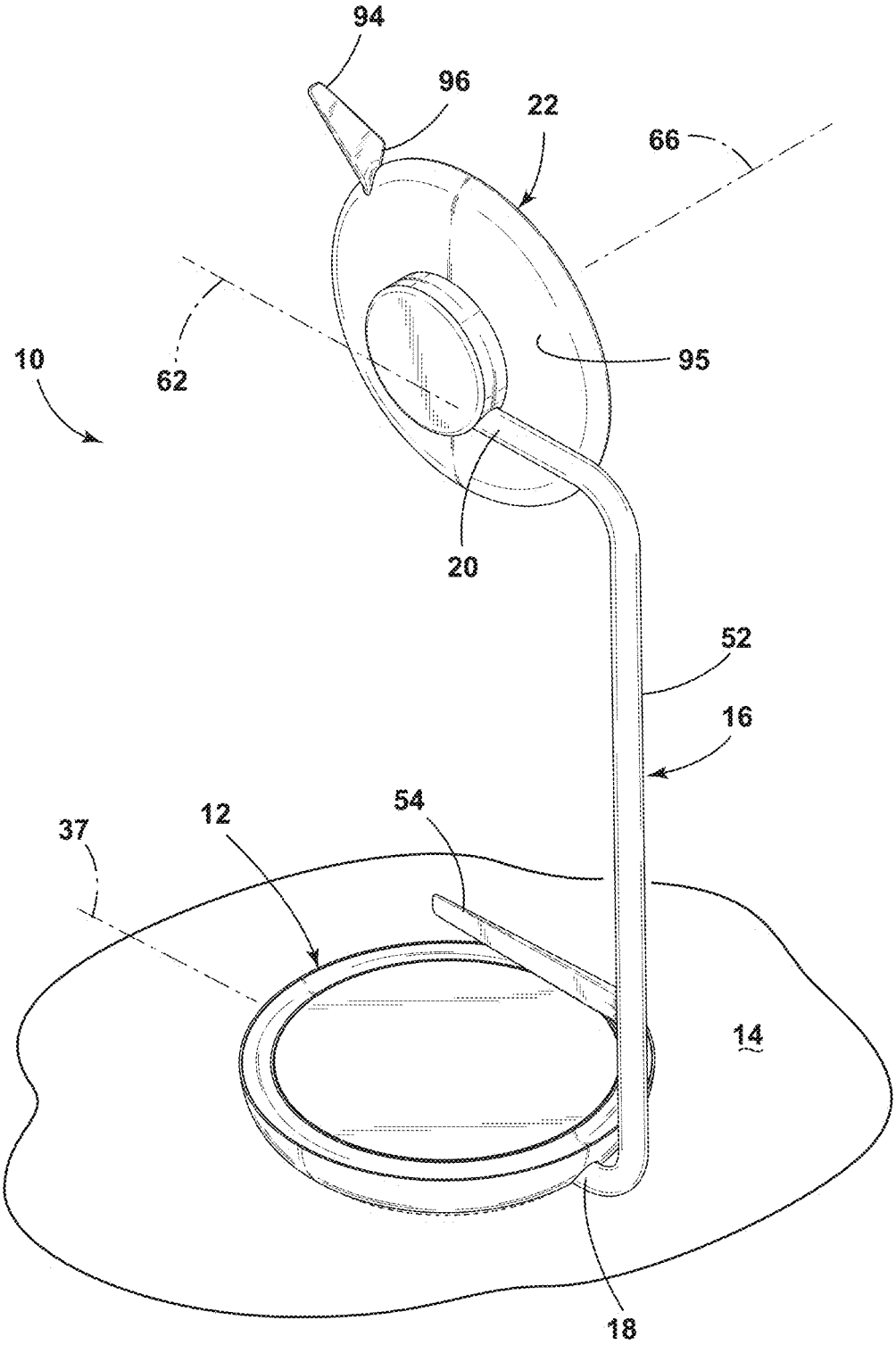
FIG. 2 is a rear perspective view of the lamp assembly.

For purposes of description herein, the terms "upper," "lower," "right," "left," "rear," "front," "vertical," "horizontal," and derivatives thereof shall relate to the invention as oriented in FIGS. 1 and 2. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other characteristics relating to the embodiments disclosed herein are not to be considered as limiting, unless the claims expressly state otherwise.

FIGS. 1 and 2 illustrate a lamp assembly 10 that includes a base assembly 12 supportable or supported on a worksurface 14, a support arm 16 having a first end 18 pivotably coupled to the base assembly 12, and a second end 20 pivotably coupled to a housing assembly 22. The lamp assembly 10 is reconfigurable between various in-use and storage/shipping mode configurations as described herein.

Figure 3:
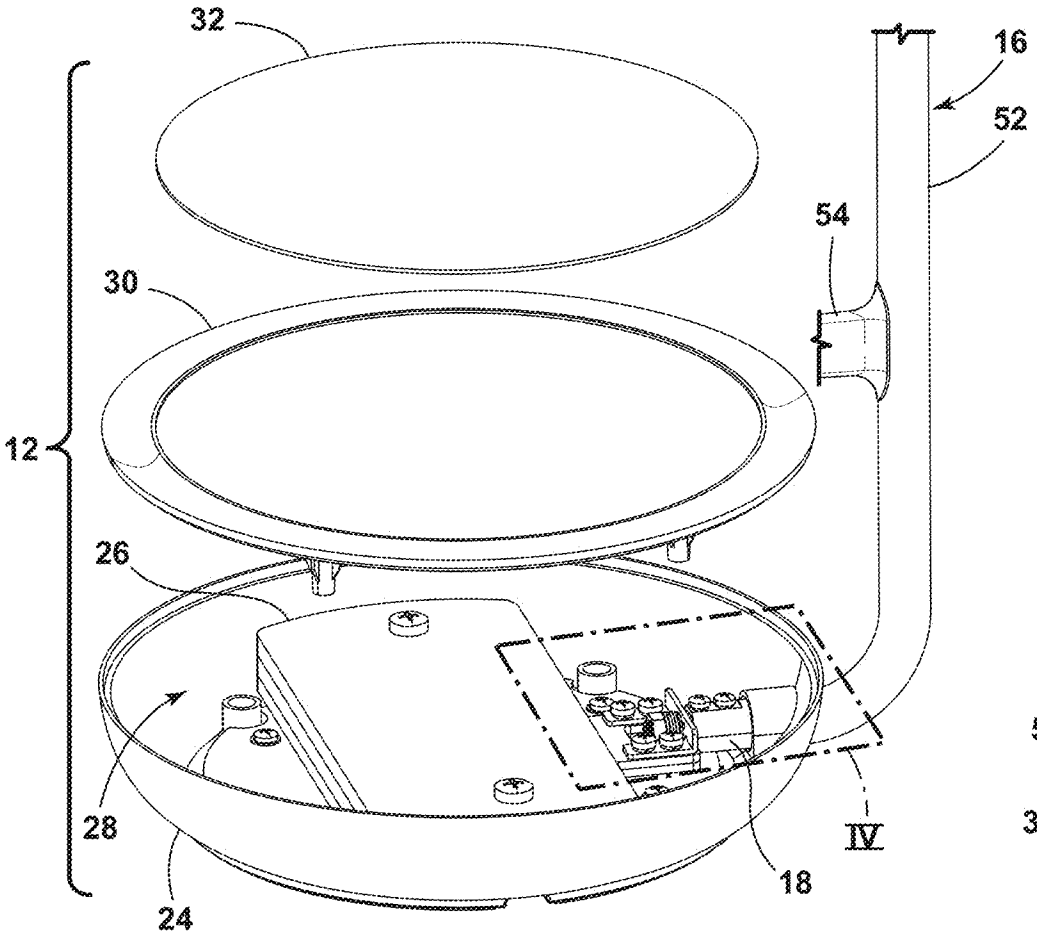
FIG. 3 is an exploded partial perspective view of a base assembly of the lamp assembly.

As best illustrated in FIG. 3, the base assembly 12 may include a housing 24, a counterweight arrangement 26 located within an interior 28 of the housing 24, and a cover 30 connected to the housing 24 via a plurality of mechanical fasteners, such as screws, not shown, and such that the cover 30 cooperates with the housing 24 to enclose the interior 28. The housing assembly 22 may also include a cover pad 32 attached to an upper surface of the cover 30.

Figure 4:
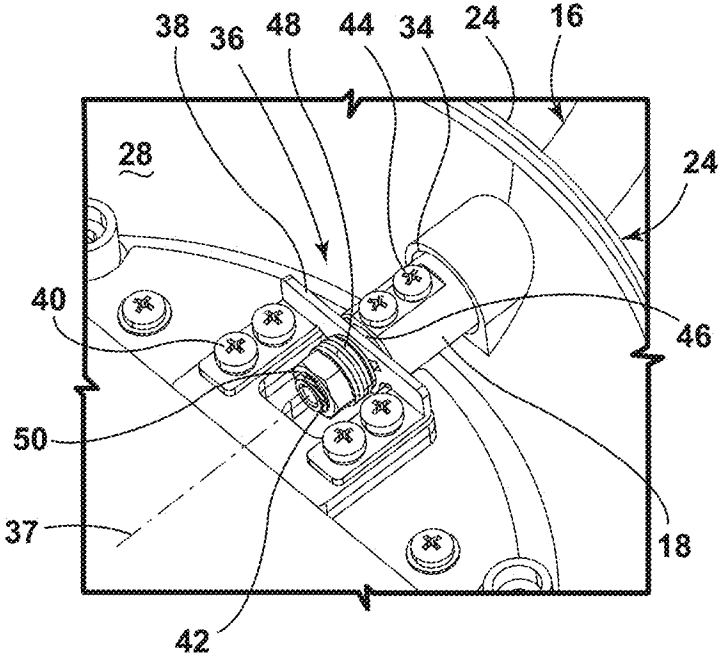
FIG. 4 is a perspective view of the area IV.

The first end 18 (FIGS. 3 and 4) of the support arm 16 may extend into the interior 28 of the housing 24 via an aperture 34 of the housing 24, and may be pivotably coupled to the housing assembly 22 via a frictional bearing arrangement 36 such that the support arm 16 may rotate about a pivot axis 37. In the illustrated example, the frictional bearing arrangement 36 includes an L-shaped support member 38 fixedly coupled to the housing 24 via a plurality of mechanical fasteners, such as screws 40, and a threaded extension 42 that is received through an aperture (not shown) of the support member 38 and into the open first end 18 of the support arm 16, where the extension 42 is secured to the second end 20 of the support arm 16 via a plurality of mechanical fasteners such as screws 44. The support member 38 is frictionally held between a friction washer or plate 46, and a plurality of locking washers 48, where the locking washers 48 are held in position via a nut 50 threadably received on the threaded extension 42. The friction washer 46 may comprise plastic, nylon, oil impregnated plastic, and the like.

The support arm 16 has a C-shaped overall configuration where the first end 18 and the second end 20 may extend orthogonally from a vertical portion 52. The support arm 16 may also include a support member 54 (FIGS. 1 and 2) that extends substantially orthogonally from the vertical portion 52 of the support arm 16 in a substantially horizontal direction. In the illustrated example, the support member 54 is tapered along the length thereof, with the support member 54 narrowing from the proximal end toward the distal end thereof. The support member 54 is configured to cooperate with the base assembly 14 to support personal electronic devices, such as phones 56, tablets 57 in a portrait orientation, tablets 58 in a landscape orientation, and the like, in an orientation that is conducive to a seated user utilizing the device, and in particular for videoconferencing functions as further described below, including horizontal and vertical orientations.

Figure 5:
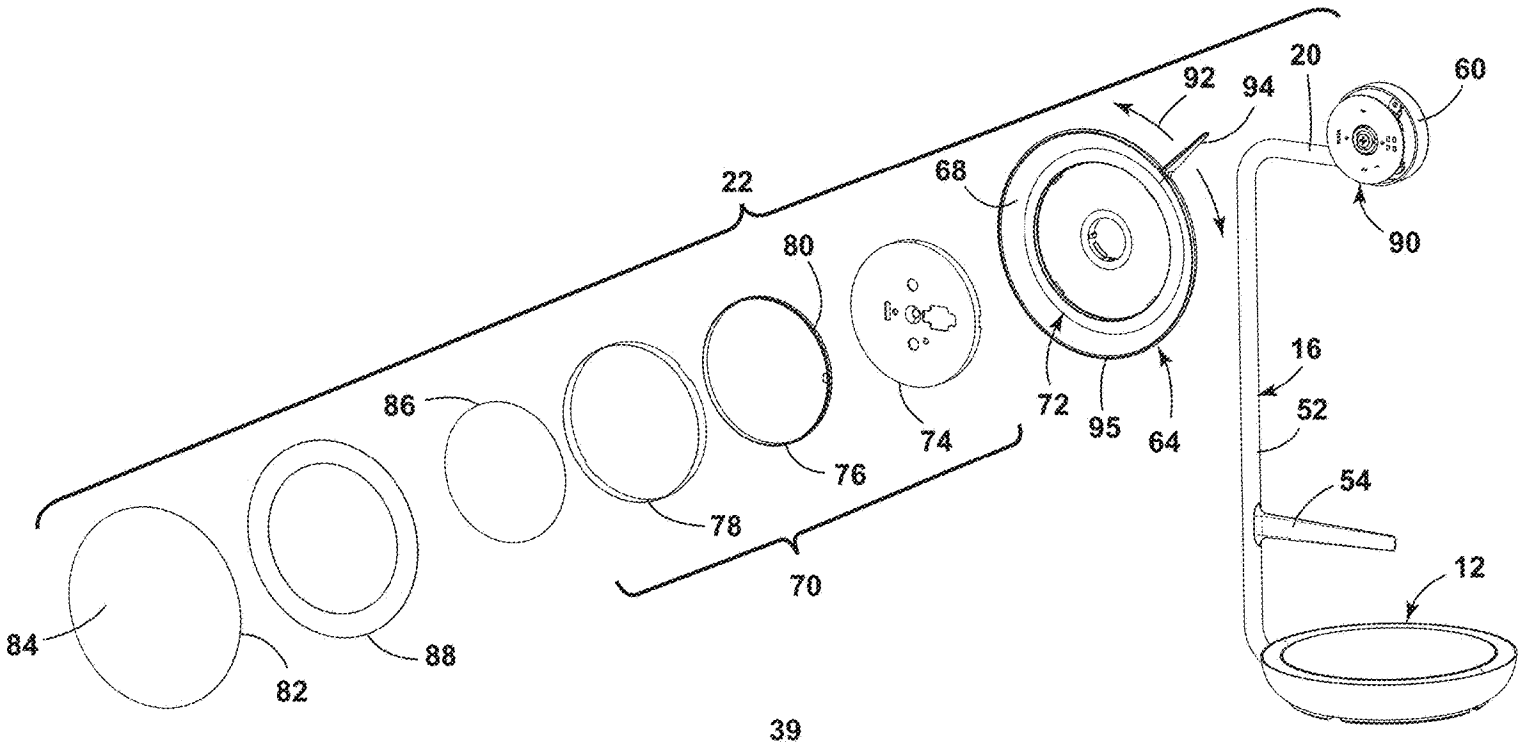
FIG. 5 is an exploded perspective view of the lamp assembly.
Figure 6:
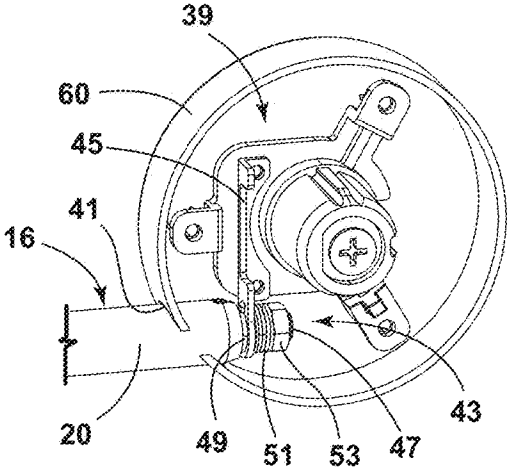
FIG. 6 is an enlarged perspective view of a connection between a housing and a support arm.

The housing assembly 22 (FIGS. 1, 2 and 5) may include a first portion 60 pivotably coupled with the second end 22 of the support arm 16 for pivoting about a pivot axis 62, and a second portion 64 rotatably coupled with the first portion 60, such that the second portion 64 is configured to pivot about a pivot axis 66. As best illustrated in FIG. 6, the second end 20 of the support arm 16 may extend into an interior 39 of the first portion 60 of the housing assembly 22 via an aperture 41 of the first portion 60, and may be pivotably coupled to the first portion 60 via a frictional bearing arrangement 43 such that the first portion 60 and the overall housing assembly 22 may rotate about the pivot axis 62. In the illustrated example, the frictional bearing arrangement 43 includes a support member 45 fixedly secured to the first portion 60, and a threaded extension 47 that is received through an aperture (not shown) in the support member 45 and into the open second end 20 of the support arm 16. The support member 45 is frictionally held between a friction washer or plate 49, and a plurality of locking washers 51, where the locking washers 51 are held in position via a nut 53 threadably received in the threaded extension 47. The friction washer 49 may comprise nylon, plastic, oil impregnated plastic, and the like.

In the illustrated example, the second portion 64 of the housing assembly 22 is bell-shaped and includes a reflective surface 68 which may be coated with a reflective material, such as brass, where the reflective surface 68 may be arcuately-shaped. A lighting arrangement 70 is located within an interior 72 of the second portion 64, where the lighting arrangement 70 may include a heat sink 74, an LED board 76, and a diffuser 78. The LED board 76 may be provided with a cylindrical or circular configuration where a plurality of individual LEDs 80 are spaced about the LED board 76. Similarly, the diffuser 78 may be provided with a cylindrical or circular configuration where the LED board 76 is secured to an outer surface of the heat sink 74 and the diffuser 78 encircles the LED board 76. A mirror 82 having a reflective outer surface 84 is located within the second portion 64 and may be secured to the heat sink 74 via a double-sided tape 86. A disk-shaped reflector 88 may be secured to the mirror 82 opposite the reflective surface 84.

A rotary encoder 90 is coupled to the first portion 60 and the second portion 64, and operably coupled to the lighting arrangement 70, and is operable so as to control the light intensity of light emitted from the LED board 76. Specifically, the rotary encoder 90 is coupled to the first portion 60 and the second portion 64 of the housing assembly 22 such that rotational movement of the second portion or hood 64 of the housing assembly 22 about the pivot axis 66 in the directions 92 actuates the rotary encoder 90 so as to control the light intensity of the light emitted from the LED board 76. It is noted that during operation, second portion or hood 64, the reflective surface 68, the tab 94, and a portion of the rotary encoder 90 rotate together as a single unit as the intensity of the light emitted from the lighting arrangement 70 is adjusted. It is also noted that other light control arrangements in addition to or alternatively to the rotary encoder 90 may be utilized, including but not limited to a potentiometer.

The second portion 64 (FIGS. 2 and 5) of the housing assembly 22 may include a graspable tab or lever 94 extending from a main body portion 95 of the second portion 64. In the illustrated example, the tab or handle 94 extends outwardly from an outermost peripheral edge of the main body portion 95 of the second portion 64 so as to be easily graspable by the user. It is also noted that the tab 94 may include a forwardly extending edge 96 also configured to aid in a user grasping the tab 94. Further, the configuration and orientation of the tab 94 with respect to the second portion 64, the housing assembly 22, and the overall lamp assembly 10 provides the user with a distinct visual impression such that the user can easily remember preferred light intensities as previously identified and experienced while adjusting and using the lamp assembly 10.

Figure 7C:
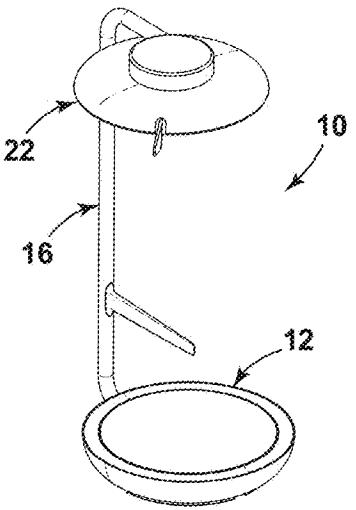
FIG. 7C is a perspective view of the lamp assembly in an ambient lighting mode configuration.
Figure 7B:
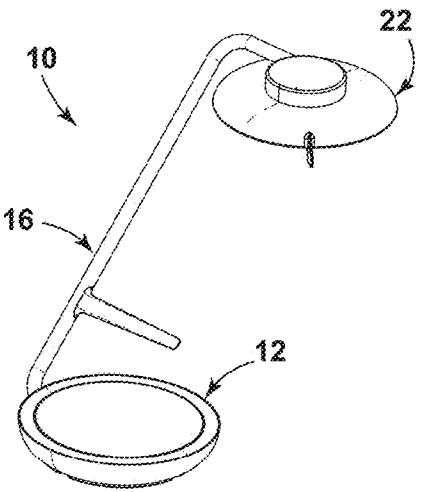
FIG. 7B is a perspective view of the lamp assembly in a rearwardly-oriented desk lamp mode configuration.
Figure 7A:
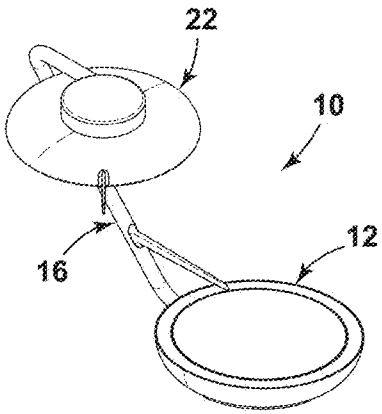
FIG. 7A is a perspective view of the lamp assembly in a forwardly-oriented desk lamp mode configuration.
Figure 7F:
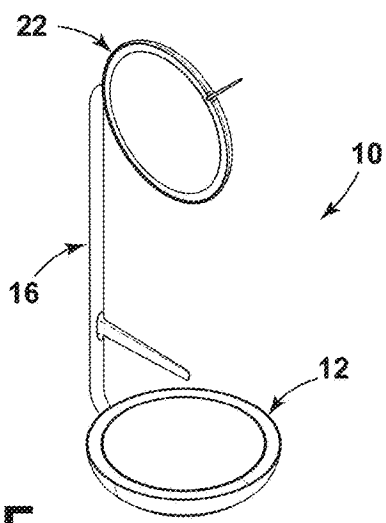
FIG. 7F is a perspective view of the lamp assembly in a centered or centrally-oriented videoconferencing mode configuration.
Figure 7E:
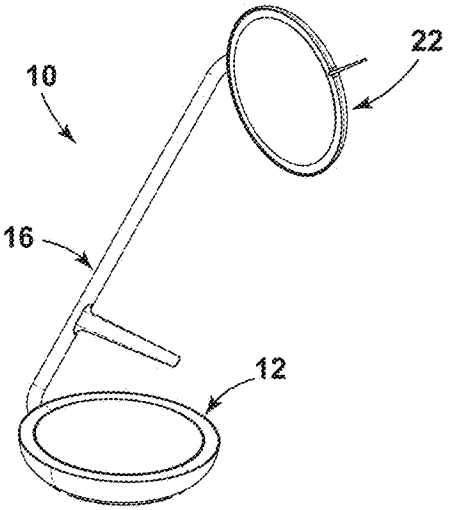
FIG. 7E is a perspective view of the lamp assembly in a rearwardly-oriented videoconferencing mode configuration.
Figure 7D:
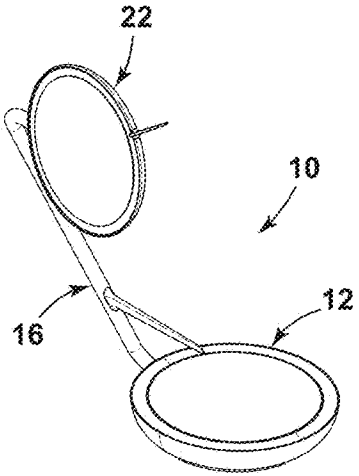
FIG. 7D is a perspective view of the lamp assembly in a forwardly-oriented videoconferencing mode configuration.

The overall lamp assembly 10 is easily reconfigurable between a plurality of use modes, including a forwardly-oriented desk lamp mode (FIG. 7A) where the housing assembly 22 is positioned forwardly of the base assembly 12 and the light emitted from the lighting arrangement 70 is directed toward the worksurface 14 while the reflective surface 68 faces the worksurface 14, a rearwardly-oriented desk lamp mode (FIG. 7B) where the housing assembly 22 is positioned rearwardly of the base assembly 12 and the light emitted from the lighting arrangement 70 is directed toward the worksurface 14 while the reflective surface 68 faces the worksurface 14, an ambient lighting mode (FIG. 7C) where the housing assembly 22 is positioned directly vertically above the base assembly 12 and the light emitted from the lighting arrangement 70 is directed toward the worksurface 14 while the reflective surface 68 faces the worksurface 14, a forwardly-oriented videoconferencing mode (FIG. 7D) where the housing assembly 22 is positioned at least partially forward of the base assembly 12 and is rotated such that the light emitted from the lighting arrangement 70 is directed toward the face of a seated user and the reflective surface 68 faces the face of the seated user and such that the lighting arrangement 70 and the reflective surface 68 might be positioned relatively closer to the face of the user, a rearwardly-oriented videoconferencing mode (FIG. 7E) where the housing assembly 22 is positioned at least partially rearward of the base assembly 12 and rotated such that the light emitted from the lighting arrangement 70 is directed toward the face of the seater user and the reflective surface 68 faces the face of the seated user and such that the lighting arrangement 70 and the reflective surface 68 might be positioned relatively further away from the face of the user, and a centered or centrally-oriented videoconferencing mode (FIG. 7F) where the housing assembly is positioned directly above the base assembly 12 and is rotated such that the light emitted from the lighting arrangement 70 is directed toward the face of a seated user and the reflective surface faces the face of the seated user and such that the lighting arrangement 70 and the reflective surface 68 might be positioned at an intermediate distance from the user. It is noted that in the various videoconferencing modes, the housing assembly 22 may be positioned forwardly, rearwardly or directly above the base assembly 12, and that the base assembly 12, the support arm 16 and the housing assembly 22 may extend at various relative angles with respect to one another to allow the lamp assembly 10 to be adapted for use in numerous seating configurations by users of varying heights. It is further noted that the overall lamp assembly 10 is highly effective for use during videoconferencing, where the lamp assembly 10 provides support for the user's personal electronic device, such as a phone 56 or tablet 58 directing the screen toward the face of the seated user, the lighting arrangement 70 provides optimally controllable lighting of the user, and the mirror 82 provides the user with an immediate feedback as to the effects of the lighting. Specifically, the overall adjustability of the lamp assembly 10 allows the user to simultaneously optimize the lighting effects provided by the lamp assembly 10 and positioning of the personal electronic device regardless of the sitting or standing position of the user, allowing the user to adjust the positioning and orientation of the personal electronic device, the intensity of the light emitted from the lighting arrangement, the relative angle at which the light emitted from the lighting arrangement illuminates the user's face, and the distance between the lighting arrangement and the user, and provides immediate feedback to the user via the reflective surface or mirror, thereby allowing the user to adjust the lamp assembly 10 and to achieve the videoconferencing image or effects as desired.

In the foregoing description, it will be readily appreciated by those skilled in the art that alternative combinations of the various components and elements as described herein and modifications thereto may be made without departing from the concepts disclosed herein. Such modifications are to be considered as included in the following claims, unless these claims by their language expressly state otherwise.

The invention claimed is:

1. A lamp assembly, comprising:

a base configured to be supported on a worksurface;

a support arm having a first end rotationally pivotably coupled to the base, and a second end;

a housing rotationally pivotably coupled to the second end of the support arm;

a mirror supported by the housing and having a reflective surface facing in a first direction; and a light arrangement supported in the housing and including a light element, the light arrangement configured to emit a light in the first direction;

wherein the base, the support arm, and the housing are reconfigurable between a first configuration where the housing is located vertically above the base and the reflective surface is substantially parallel with the worksurface, a second configuration where the housing is located vertically above the base and the reflective surface is substantially perpendicular to the worksurface, and a third configuration where the housing is located at least partially rearward of the base and the reflective surface is substantially perpendicular to the worksurface.

2. The lamp assembly of claim 1, wherein the housing is located at least partially forward of the base, when the base, the support arm and the housing are in the first configuration.

3. The lamp assembly of claim 1, wherein the base, the support arm and the housing are further reconfigurable into a fourth configuration where the housing is located at least partially directly vertically above the base.

4. The lamp assembly of claim 1, wherein the lighting arrangement includes at least one light emitting diode.

5. The lamp assembly of claim 4, wherein the at least one light emitting diode includes a plurality of light emitting diodes.

6. The lamp assembly of claim 1, wherein the lighting arrangement includes a lighting element that extends about a periphery of the mirror.

7. The lamp assembly of claim 1, wherein the lighting arrangement includes a reflective member extending about a periphery of the mirror, and wherein the reflective member redirects the light toward the first direction.

8. The lamp assembly of claim 1, further comprising:

a support member coupled to and extending from the support arm and configured to support a personal communication device.

9. The lamp assembly of claim 8, wherein the support member includes a substantially rigid bar extending substantially perpendicular to the support arm.

10. The lamp assembly of claim 1, wherein the lighting arrangement is configured to control the intensity of the light.

11. The lamp assembly of claim 10, wherein the housing includes a hood that at least partially houses the light arrangement, and wherein rotation of the hood controls the intensity of the light.

12. The lamp assembly of claim 11, wherein the housing includes a graspable handle extending outwardly from an outer periphery of the hood.

13. The lamp assembly of claim 10, wherein the lighting arrangement includes a rotatory encoder configured to control the intensity of the light.

14. A lamp assembly, comprising:

a base configured to be supported on a worksurface;

a support arm having a first end operably coupled to the base, and a second end;

a housing operably coupled to the second end of the support arm;

a lighting arrangement supported in the housing and including a lighting element configured to emit a light, wherein the lamp assembly is reconfigurable between a first configuration where the light is directed downwardly toward the worksurface, and a second configuration where the light is directed forwardly toward the face of the seated user; and a support member coupled to and extending outwardly from the support arm, wherein the base and the support arm are configured to cooperate to support a personal communication device such that a camera of the personal communication device is directed toward the face of the seated user and the personal communication device is completely horizontally offset from the support arm when supported by the base and the support member.

15. The lamp assembly of claim 14, further comprising:

a mirror supported by the housing and having a reflective surface, wherein the reflective surface is substantially parallel with the worksurface when the lamp assembly is in the first configuration and faces the face of the seated user when the lamp assembly is in the second configuration.

16. The lamp assembly of claim 14, wherein the support member includes a substantially rigid bar extending substantially perpendicular to the support arm.

17. The lamp assembly of claim 14, wherein the support arm is pivotably coupled to the base.

18. The lamp assembly of claim 14, wherein the housing is pivotably coupled to the support arm.

19. The lamp assembly of claim 14, wherein at least a portion of the housing is located forward of the base when the lamp is in the first configuration.

20. The lamp assembly of claim 14, wherein the lamp assembly is further reconfigurable to a third configuration where the housing is located at least partially rearward of the base.

21. The lamp assembly of claim 14, wherein the second direction is about 90° from the first direction.

22. A lamp assembly, comprising:

a base configured to be supported on a worksurface;

a support arm having a first end operably coupled to the base, and a second end;

a housing assembly operably coupled to the second end of the support arm and having a central axis, the housing assembly including a hood and a graspable handle extending from the hood; and a light arrangement supported by the housing assembly and including a light element configured to emit a light, the hood operably coupled to the light element such that rotation of the hood about the central axis controls an intensity of the light.

23. The lamp assembly of claim 22, wherein the graspable handle extends outwardly from an outermost peripheral edge of the hood.

24. The lamp assembly of claim 22, further comprising: a mirror supported by the housing assembly.

25. The lamp assembly of claim 22, wherein the light arrangement includes a reflector.

26. The lamp assembly of claim 25, wherein the reflector is fixed with respect to the hood.

27. The lamp assembly of claim 22, wherein the lighting arrangement further includes a rotary encoder located within the housing assembly and operably coupled to the hood to the lighting element.

28. The lamp assembly of claim 22, wherein the lamp assembly is reconfigurable between a first configuration where the light is directed toward the worksurface, and a second configuration where the light is directed toward the face of the seater user.

* * * * *